US006609666B1

(12) United States Patent
Blake

(10) Patent No.: US 6,609,666 B1
(45) Date of Patent: Aug. 26, 2003

(54) UNITARY OVER-MOLD NON-CLOG SYSTEM WITH POSITIVE SHUTOFF

(76) Inventor: William Sydney Blake, 14 Georgetown Ct., Linwood, NJ (US) 08221

( * ) Notice: Subject to any disclaimer, the term of this patent is extended or adjusted under 35 U.S.C. 154(b) by 0 days.

(21) Appl. No.: 10/201,817

(22) Filed: Jul. 24, 2002

(51) Int. Cl.[7] ..... B05B 1/34; F23D 11/38

(52) U.S. Cl. ..... 239/464; 239/337; 239/533.13; 239/106; 222/493; 222/496

(58) Field of Search ..... 239/464, 533.1, 239/533.13, 574, 333, 331; 222/493, 494, 496

(56) References Cited

U.S. PATENT DOCUMENTS 5,857,595 A * 1/1999 Nilson ..... 222/212
6,053,433 A * 4/2000 Py ..... 239/574
6,543,703 B2 * 4/2003 Blake ..... 239/106
2002/0030069 A1 * 3/2002 Auer ..... 222/481.5

* cited by examiner

*Primary Examiner*—Brian L. Casler
*Assistant Examiner*—Lina R Kontos

(57) ABSTRACT

A unitary over-molded non-clogging system having mechanical breakup capability, a positive shutoff flared wall skirt, having two different overmolded materials forming a laminate combination. The soft flexible face inner portion with a flexible positive shutoff in combination, with mating sealing surface points at two distinct positions, on a conventional actuator body post, forms half of the unitary fitment. A hard portion contour forms the outer half, maintaining registration and retention of the entire overmold fitment within the actuator. This overmold combination fit provides these features without increasing the total amount of parts normally used in conventional spray actuators on pumps and aerosol systems. The actuator can employ a post with or without a mechanical breakup face while the mating surface of the inner soft interfacing portion would compliment it. This type of actuator also can be used as an outlet valve means for pumps, reducing overall cost.

12 Claims, 8 Drawing Sheets

UNITARY OVER-MOLD NON-CLOG SYSTEM WITH POSITIVE SHUTOFF

BACKGROUND OF THE INVENTION

1. Field of the Invention

The present invention relates to a particular apparatus and method of manufacturing actuators that are suitable for use on aerosol dispensers or pumping assemblies. More specifically related to an actuator assembly that resembles the conventional types which are effective in preventing or reducing partial or total clogging through the introduction of air causing the drying or hardening of the product being dispensed within the flow channels and discharge orifice of the actuator assembly between the atomization stages or over intervals of usage.

2. Description of the Related Art

Actuator assemblies that fit on top of aerosol containers or that are used as part of a pumping system have been used for many years to dispense liquid or product under pressure through an orifice or opening. Often, the liquid or product is atomized via a (MBU) mechanical breakup means within the actuator assembly before it exits out the orifice as a fine spray using a specially configured nozzle or other mechanism. While these devices typically work well initially, they typically become partially or fully clogged as the product being dispensed dries and hardens in various flow channels and in the discharge orifice. Many of these other actuators rely on mechanical force, such as a spring or other mechanism, to open an orifice and flow channels for dispensing by withdrawing a probe or plug from the orifice and then closing the orifice after dispensing the product by moving the probe or plug back towards or into the orifice.

By way of example, U.S. Pat. No. 5,198,774 of Lund et al, discloses a combined lock and anti-clog actuator. The actuator is adjustable between a locked and an unlocked position. The locked position cooperates with an anti-clog member, which has a nozzle seal for inhibiting the clogging of the product within.

U.S. Pat. No. 5,894,964 of Barnes et al, discloses an inner actuator chamber arranged in a way designed to minimize blockage of the actuator.

U.S. Pat. No. 5,480,095 of Stevenson et al, shows an actuator that attenuates the accumulation of solidified sprayed fluid.

U.S. Pat. No. 5,687,877 of Smolen, Jr., discloses a pump dispenser with a check valve that moves forward during the pressure stroke and than closes and pulls liquid back during the suction stroke, minimizing blockage.

U.S. Pat. No. 5,560,544 of Merritt et al, discloses an anti-clogging atomizer nozzle. U.S. Pat. No. 5,358,149 of O'Neill discloses an anti-clogging means similar to U.S. Pat. No. 5,687,877 of Smolen, Jr.

U.S. Pat. No. 4,982,900 of Blake discloses a trigger sprayer with several nose piece valve configurations.

U.S. Pat. No. 5,855,322 of Py discloses a one-way valve system that utilizes a swirl chamber with radially deformed, expandable outlet flexing valving as part of a pouched reservoir system, as an inclusive assembly.

Despite the efforts of such devices as shown in the forgoing patents, there remains a need for an anti-clogging actuator that can perform a rapid positive shut off. Specifically, a product that can prevent clogging from occurring by effecting a rapid shut off; that would afford an effective shut off method to prevent product build up behind the orifice at sealing surfaces and within flow channels; and that would create a positive shut off to reduce dribbling or seeping under low pressure would be most desirable, especially if the part count remains the same as with conventional actuators while employing a method of unitary overmolding of two separate materials, accomplishing the same desired equivalent features.

SUMMARY OF THE INVENTION

It is the object of the present invention to provide a method for the apparatus, that can be manufactured economically while maintaining all the features of non-clogging and positive shutoff within an actuator that does not increase in a total number of parts that are presently available. This actuator assembly will still isolate fluid within the MBU (mechanical breakup channels and orifice), preventing air from migrating back through the same.

It is a related object of the present invention to provide a non-clogging actuator assembly that has two diaphragms in tandem with a mechanical breakup between them, the in tandem diaphragms also provide double one-way valving with flexible movement to afford mechanical breakup and positive shutoff features that respond to a predetermined threshold pressure supplied by a number of systems in present use.

It is another object of the present invention to provide a means that enables the elimination of the pump outlet valve requirements when new concepts need economic relief to manufacture competitively for same uses and still work with existing pumps and dispensers that may or can utilize those needed features.

It is another object of the present invention to provide a non-clogging actuator that has a positive shutoff to prevent or reduce dribbling or seeping.

It is another object of the present invention to provide a non-clogging actuator with or without a positive shutoff feature, that is commercially advantageous by having no increase in overall part count greater than the conventional two piece systems currently being used, while easily being molded without complex actions, and adaptable for use in existing and future aerosol systems; and which lends itself to a variety of assembly modes and an assembly sequence that allows for subassembly pre-testing before final assembly.

Additional objects, advantages, and novel features of the invention will be set forth in part in the description that follows, and in part will become apparent to those skilled in the art upon examination of the following or may be learned by the practice of the invention. The objects and advantages may be realized and attained by means of the instrumentalities and in combinations particularly pointed out in the appended claims.

To achieve the foregoing and other objects and in accordance with the purposes of the present invention, as embodied and broadly described herein, an actuator assembly is provided, that addresses the above discussed clogging and pressure decreasing at end of stroke or duration of an aerosol spray system, problems. The actuator assembly according to this invention includes a overmolded and bonded laminate structure that is fabricated through a two stage overmold process producing an inserted unitary part which is of two different materials and two different durometers ie densities, that is assembled conventionally into a standard type actuator housing having a receiving pocket with a center post that has a face configuration that interfaces with the overmoled unit, and same post having a frustrum shoulder a distance down from its face that also interfaces with the overmolded unit, as the dual in tandem diaphragms-valves with MBU configuration sandwiched in between them allows each to flex in proper order, under pre-determined threshold pressures supplied by a system providing them. According to this invention, a flexible diaphragm flexes away from the first and second mating seal surfaces when product under pressure flows into contact with these flexible in tandem diaphragms. These in tandem diaphragms then resiliently springs back into abutting, biased sealing contact, shutting off the mating surfaces providing the positive shutoff feature desired. Preferably, the apparatus flexes away from the two mating surfaces at a predetermined minimum pressure, which can be set at various thresholds for various needed product categories, thereby controlling the dispensing of those products (i.e., the product is dispensed in a fairly constant pattern and then shut off rather than being very strong at the beginning of the spraying process and then dribbling out at the end or under low pressure operations). Those skilled in the art will recognize that any minimum predetermined pressure required to activate the disclosed assembly will vary with the type material and the geometry selected for the individual components.

Other features and advantages of the invention will become clear from the following detailed Description and drawings of particular embodiments of the actuator system and method and associated combinations and features of the present invention.

BRIEF DESCRIPTION OF THE DRAWINGS

The accompanying drawings, which are incorporated in and form a part of the specification, Illustrate the preferred embodiments of the present invention, and together with the descriptions Serve to explain the principles of the invention.

In the Drawings.

DETAILED DESCRIPTION OF THE INVENTION

With the above assembly in mind, it may now be helpful in fully understanding the inventive features of the present invention to provide in the following description a thorough and detailed discussion of specific embodiments of the invention.

Figure 1:
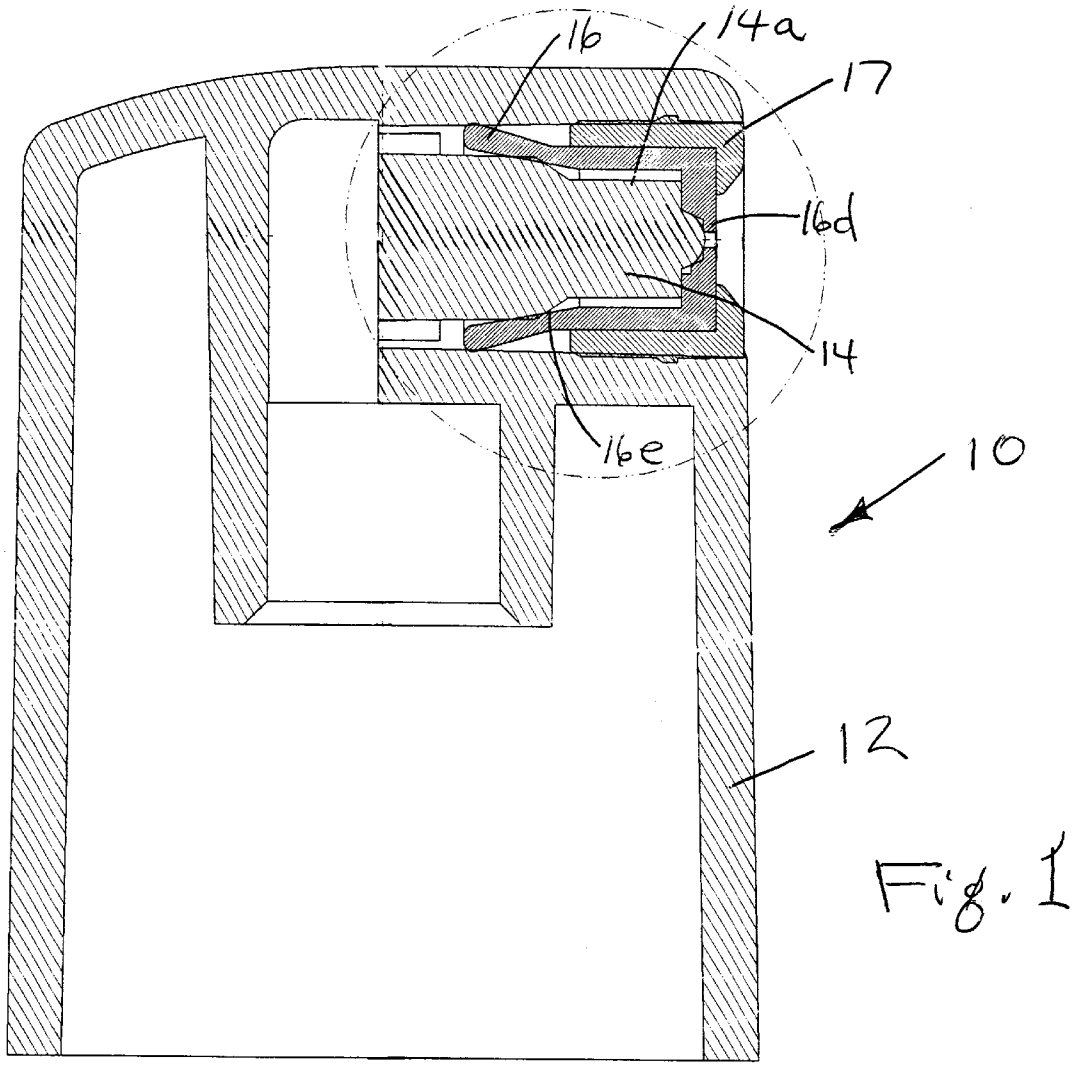
FIG. 1 is a side sectional view of the preferred embodiment of the actuator assembly of this invention.
Figure 2:
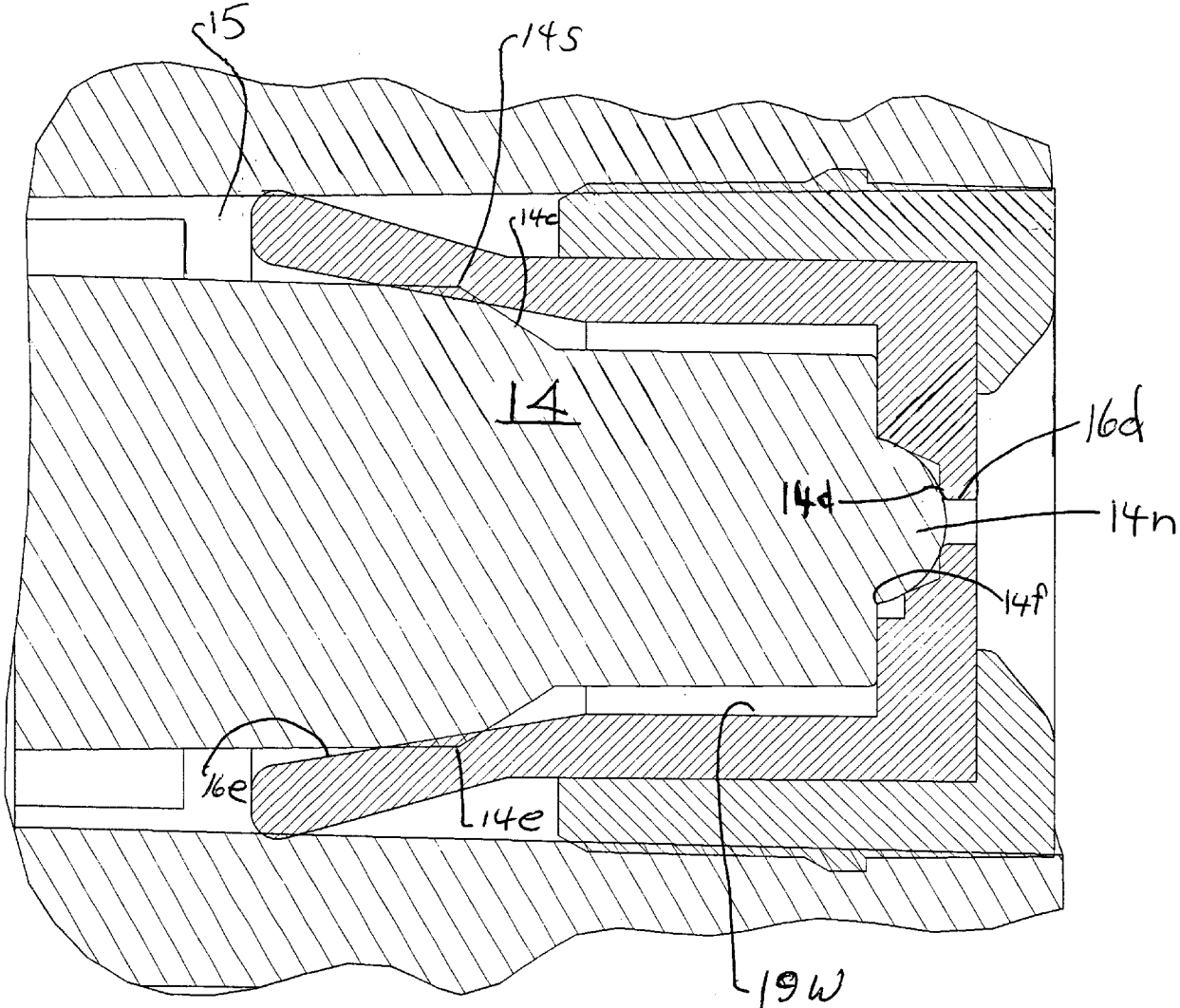
FIG. 2 is a partial sectional side view blowup of the actuator assembly of FIG. 1.

Most generally, and referring to FIGS. 1–6, it may be seen in overview that the actuator assembly 10 according to this invention provides a flexible diaphragm face member (or inner fitment half) 16 and (outer fitment half) 17 that form an overmold unitary insert 20 with flexible diaphragms 16*d* and 16*e* that flexes away from first and second positive shutoff mating surfaces (a first mating surface at side 14*a* at point 14*e* of post 14 and a second mating surface at face 16*d* of post 14, at the surface points 14*d* and 14*f* as shown for example in FIG. 2) when product under pressure flows into contact with the flexible diaphragm face member 16. From viewing the figures, it may be understood that the flexible diaphragm face at points 16*e* and 16*d* then resiliently springs back into abutting, sealing contact with these shutoff mating surfaces 14*e*, 14*d*, and 14*f*, when the pressure has decreased. Preferably, the flexible face member 16 flexes away from the three shutoff mating surfaces at a predetermined minimum pressure and then flexes back into sealing contact when the product drops below this minimum pressure, thereby controlling the dispensing of the product (i.e., the product is dispensed in a fairly constant pattern and then shut off rather than being very strong at the beginning of the spraying process and then dribbling out at the end or low pressure operations).

FIG. 1 illustrates a side view of the actuator assembly 10 and FIG. 2 illustrates a partial side view blowup of the actuator assembly 10. The actuator portion 12 is shown in FIG. 1 as a dashed circle, and this is the portion of the actuator assembly 10 that provides flow control features (i.e., anti-clogging features and anti-dribbling features).

As shown in FIG. 2, the actuator 12 comprises a post 14 about which product can flow in through a feed channel 15. The actuator assembly 10 is seated (not shown) on a pump or valve stem which normally connects to a pressurizing system supplying product under pressure to the actuator assembly 10 as shown in the closed position so that product cannot exit the actuator 12. The actuator 12 further includes a flexible diaphragm face fitment inner half of the overmold 16 which is part of the bonded compression fitment outer half of this combination, forming the two different materials of two different durometers as combined halves of a unitary part insert 20, fabricated by the overmold process. 16 is the flexing member of the overmold insert 20, and provides the resiliency needed for flexing away from post 14 at three positions on post, one being at the interface of the post face 14*f* another 14*d* and 14*e* being at a distance positioned down from the face 14*f*, at a point 14*s* on the post shoulder and at the frustrum 14*c*. When the location points 14*e*, 14*f* and 14*d* along with the feed channel 15, reaches a predetermined minimum pressure, the flexing member 16 then returns to its original shape at the sealing contact points they interface with and the pressure is reduced below that minimum pressure. The flexible diaphragm inner half of the overmold is bonded to the compression fitment outer half 17, which also defines the location and amount of flexing or change in shape that the flexible diaphragm fitment face 16 undergoes when under pressures above the minimum pressure.

Figure 5B:
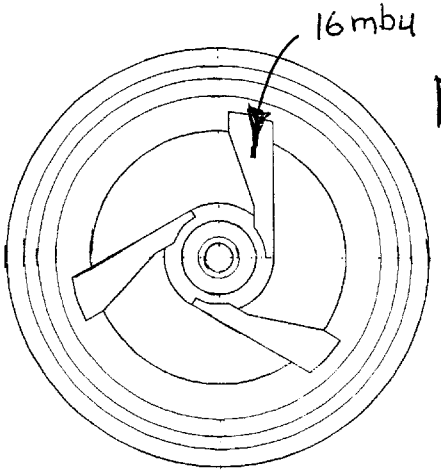
FIG. 5B is a bottom isometric view of the overmold inner half of the overmold in FIG. 3.
Figure 5A:
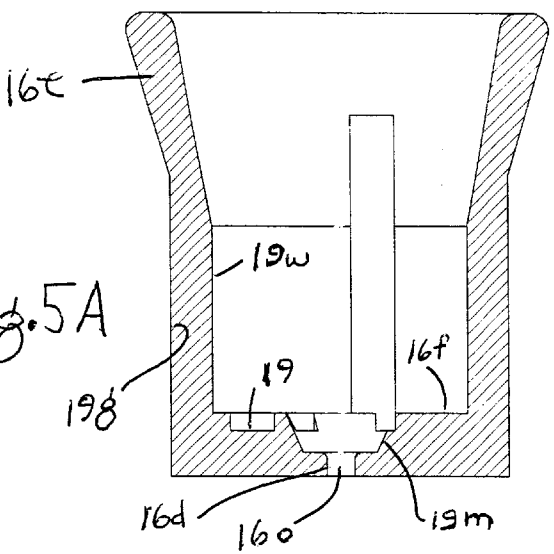
FIG. 5A is a detailed sectional view of the inner half of the overmold from FIG. 3.
Figure 5:
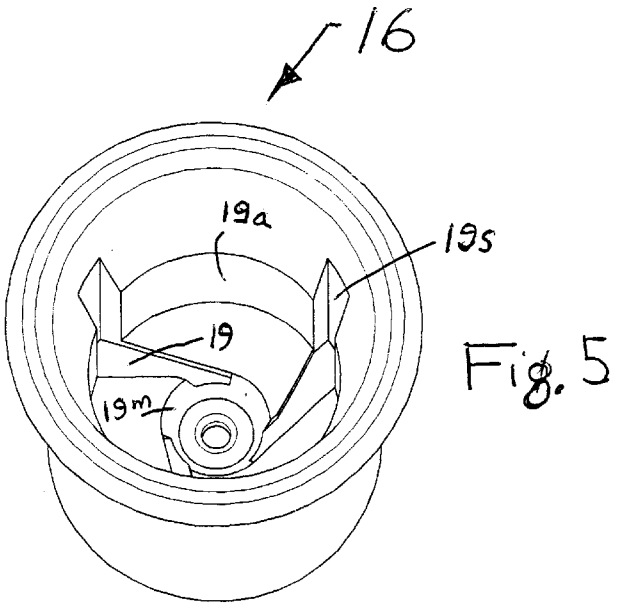
FIG. 5 is a detail view looking into the bottom and showing the vortexing channels and mechanical breakup pattern detail of the inner half of the overmold from FIG. 3.

As shown in FIGS. 2 and 5, the flexible diaphragm inner half 16 is constructed as shown whereas it is the resilient member that flexes away from seal points as described above. This portion of the unitary fitment 20 contains all the vortexing elements required of a mechanical breakup system. Tangentials 19 are fed by feed slots 19*s* and the product enters by way of 15 in the actuator assembly as illustrated in FIG. 2. The product then is directed into a conical manifold 19*m* that receives the turbolated product provided by the tangential grooves 19, and upon a predetermined threshold pressure, opens the upper diaphragm 16*d*, emitting an aerosol spray pattern. The straight side wall 19*a* with vertical feed slots 19*s* of the flexible fitment inner half 16 are fitted with interference to the straight side wall of the actuator post 14.

Figure 4A:
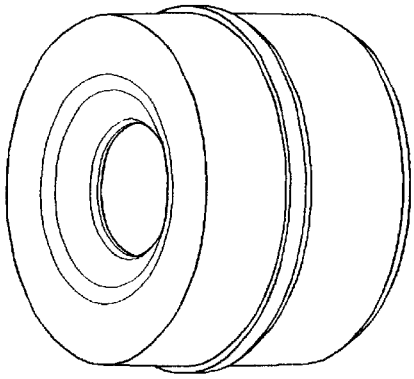
FIG. 4A shows an isometric view of the outer half of the outer half of the overmold of FIG. 3.
Figure 4:
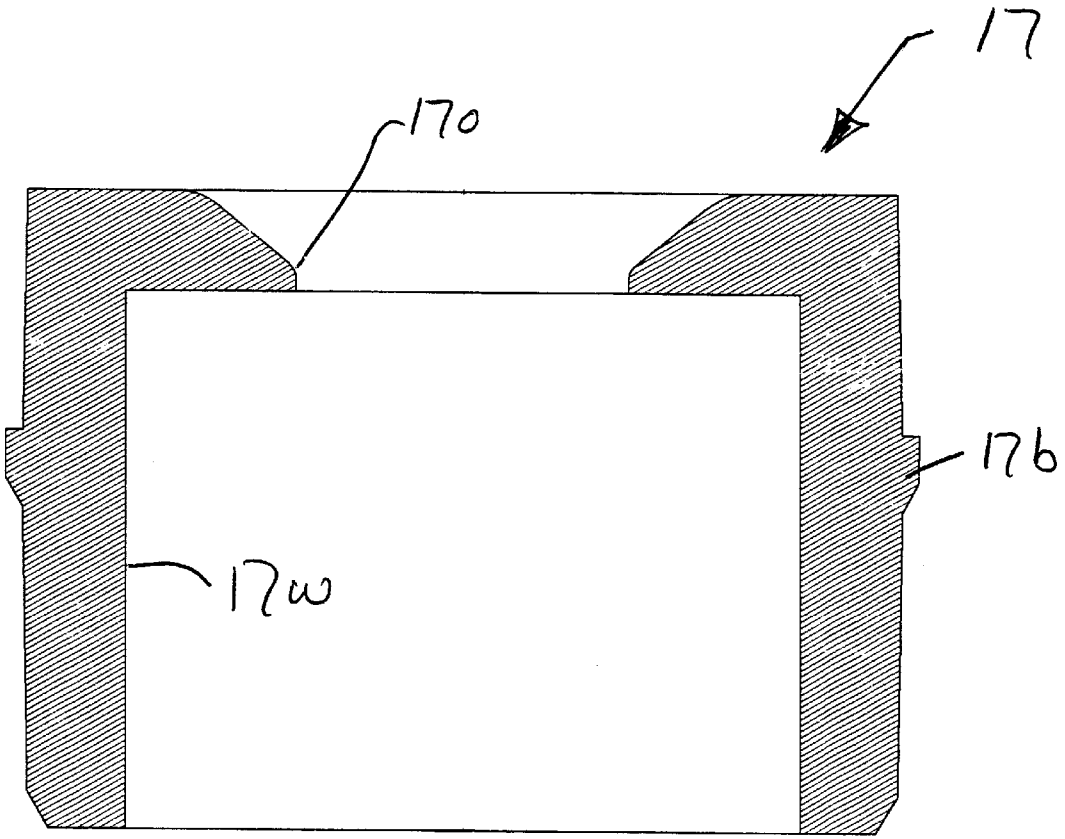
FIG. 4 is a detailed sectional of the outer half of the overmold from FIG. 3.

As shown in FIG. 4 the compression outer half 17 of the unitary fitment 20, restricts the upper biased flexible diaphragm of 16*d*, enabling proper movement required to respond to a predetermined threshold pressure and to facilitate the desired spray pattern. 17*b* are retention barbs or a ring that keeps the insert overmold unitary fitment in place, within the receiving pocket 12*p* within the actuator housing 12. 17*o* is the exit opening for the spray pattern and is designed to limit impingement of same. 17*w* is the wall for the bond to 19*g* of 16.

Figure 3A:
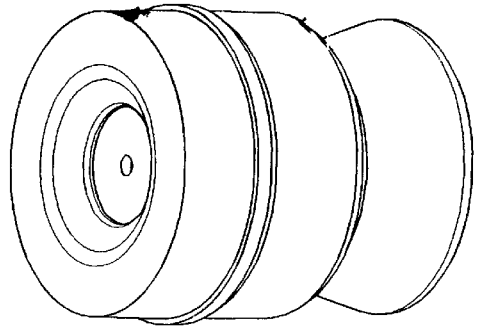
FIG. 3A shows an isometric view of the overmold assembly.
Figure 3:
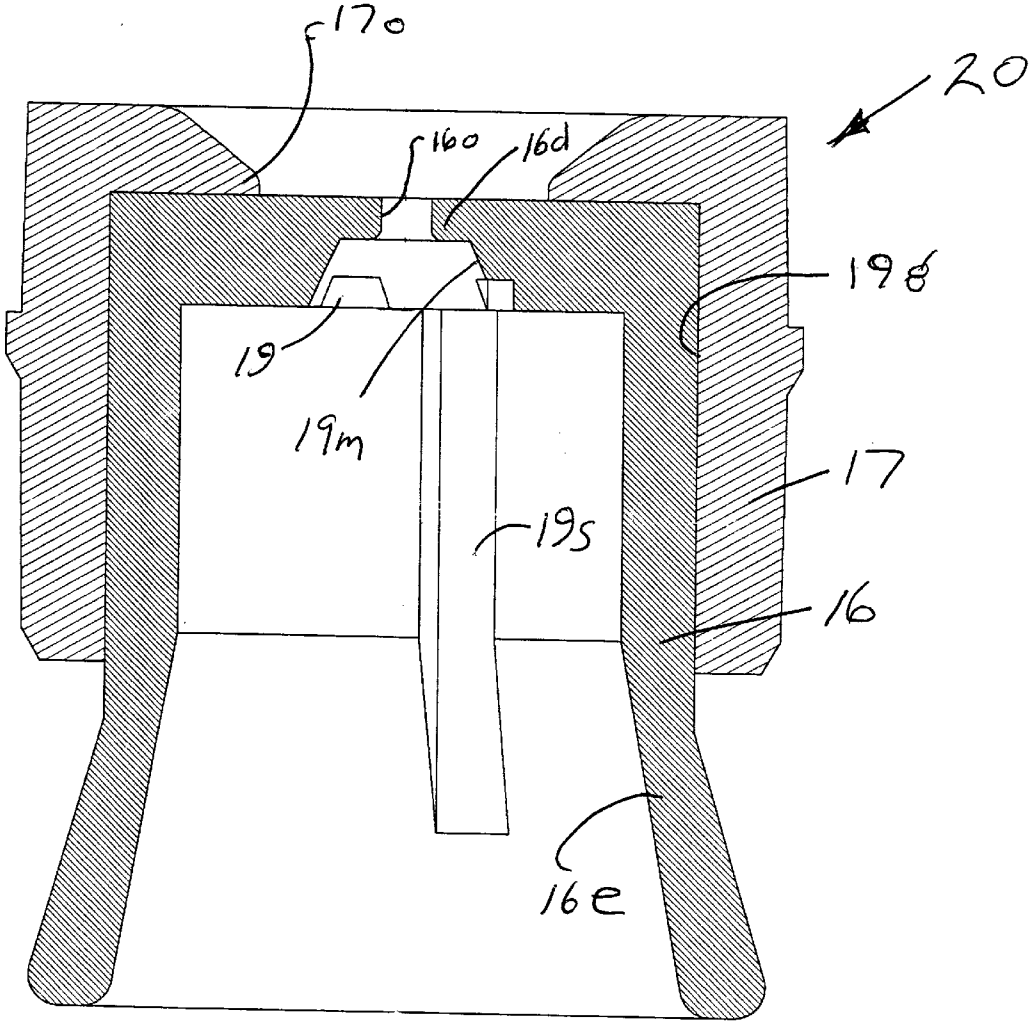
FIG. 3 is a detailed sectional of the overmold from FIG. 1, showing the combined bonded laminate of the two different overmold halves as a unitary part, before assembly with a front isometric view of same.

As shown in FIG. 3, unitary overmold fitment 20 is illustrating how the bonded laminate combination of 16 to 17 looks in cross section as well as a isomeric view of same, before it is inserted into the actuator pocket 12*p* of the actuator housing 12.

Figure 6B:
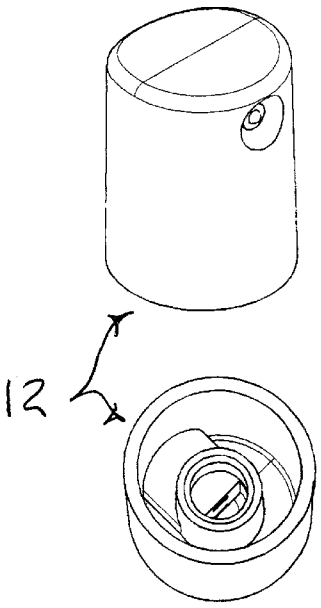
FIG. 6B is two isometric views of the actuator housing.
Figure 6:
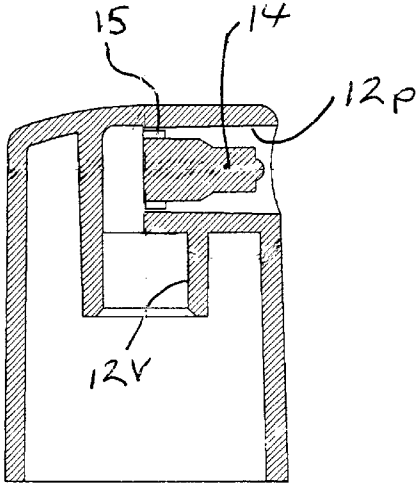
FIG. 6 is a detailed sectional view of the actuator housing from FIG. 1.
Figure 6A:
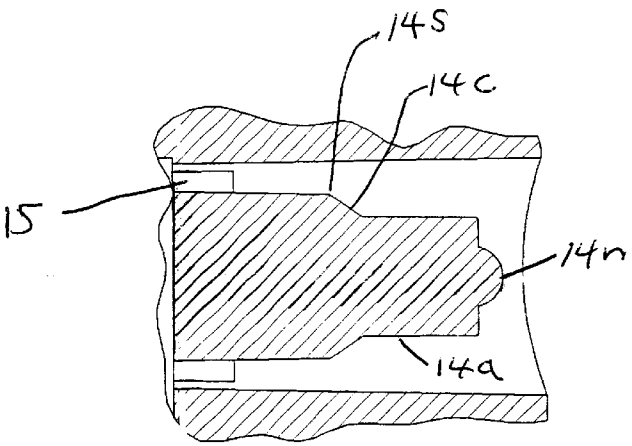
FIG. 6A is a partial detailed blowup of the post and insert pocket of the actuator housing from FIG. 6.

As in FIG. 6, the actuator housing is illustrated as shown whereas a pump or valve pocket 12*v* receives a pump stem or valve stem usually part of a pump or valve system. 14 is the post that the unitary overmold insert 20 surrounds and accommodates the in tandem diaphragm-valves interface with proper fit at points 14*c* and the nipple 14*n* that facilitates flow of product under pressure by way of the mechanical breakup 16 mbu configuration positioned in the flexible diaphragm inner half, see FIG. 5. The MBU portion 16 mbu interfaceces with the actuator hemispheric nipple 14*n* on the post face 14, see FIG. 6. MBU configurations are regulated through factors obtained by formulas known to those skilled in the state of the art technology. Of course, the MBU of 16 mbu can also be on the face of the actuator post 14, surrounding the hemispheric nipple 14*n* on the post face, see FIG. 6. The flexible diaphragm area having 16 mbu would be smooth and interface accordingly, with resulting parity.

To further understand the features of the invention, it may be useful to provide a quick overview of the movement of the components during operation of the actuator assembly 10.

When the actuator assembly 10 is closed or shut, the flexible diaphragm fitment inner half 16 is in a biased state and "at rest" position (see FIGS. 1 and 2) in which the flared skirt of 16*e* of the flexible diaphragm inner fitment half 16 is interferenced between the actuator pocket 12*p* and post shoulder 14*s* of the actuator assembly 10. The side walls 14*a* of the post 14 of the actuator housing and 19*w* of the flexible diaphragm fitment inner half 16 are sealably in contact with the side mating surface with the area around the vertical feeder channels 19*s* and the interfacing of 14*f* of the actuator post face to the flexible diaphragm fitment inner half floor 16*f* but not with the tangentials 19 (see FIG. 5). Also the upper diaphragm of the in tandem dual, is biased in sealably contacting the hemispheric nipple 14*n* as centered on the actuator housing post 14. With the above condition, there is no path for product to follow in the biased static mode. However, when a pressure reaches the controlled threshold that overcomes the lower diaphragm seal surface-shutoff valve, product passes through the vertical feeder channel in 16, and enters the vortexing mechanical breakup 16 mbu configuration in 16, onto the hemispheric nipple 14*n*, overcomes the upper diaphragm biased seal surface and exits the outlet orifice 16*o* as an aerosolized spray pattern. This system will also accommodate any pump that would omit an internal outlet valve device or a new concept as such.

Figure 7:
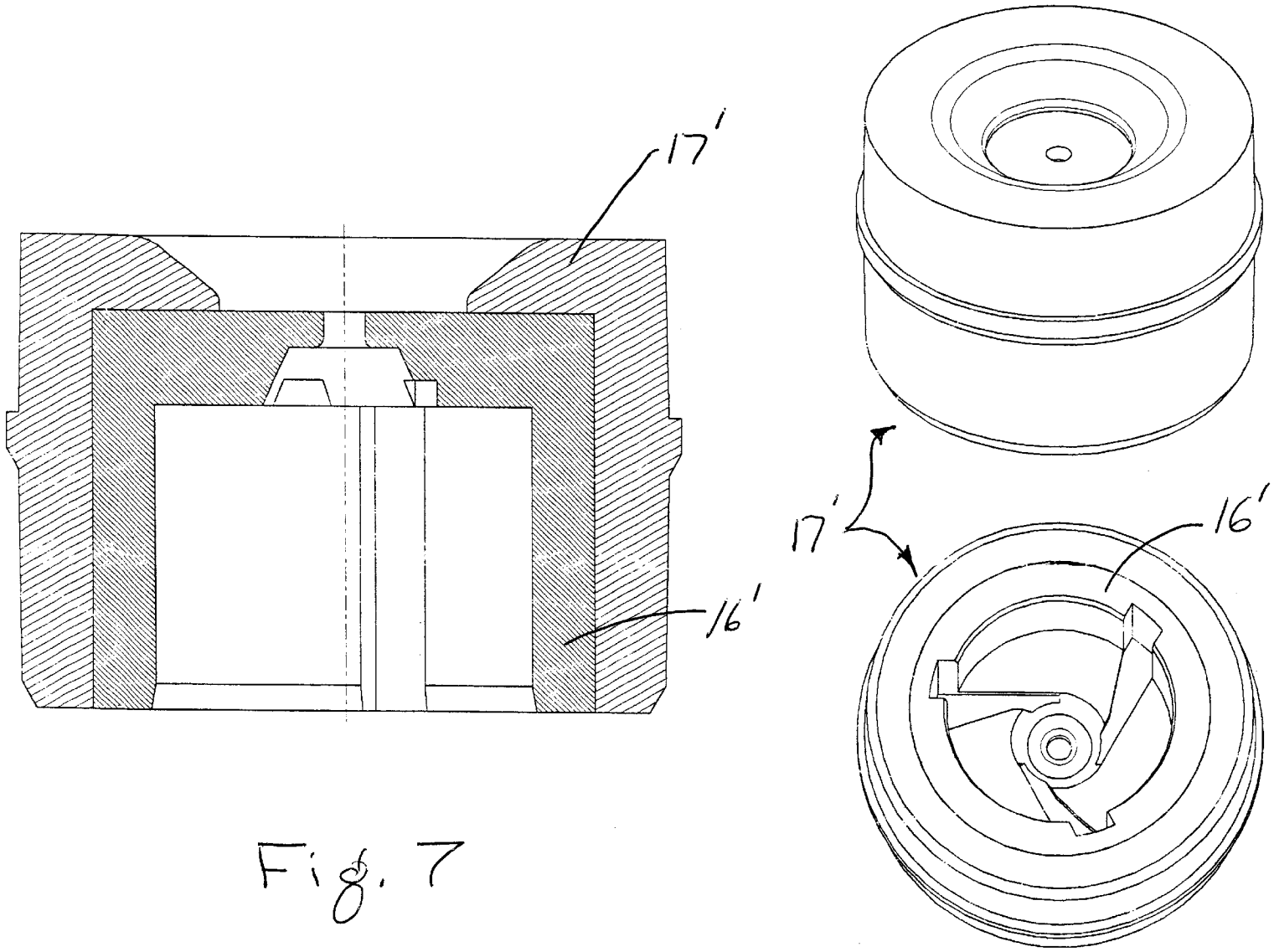
FIG. 7 is a detailed sectional view of another means of the overmold concept showing a simpler version with isometric top and bottom supportive views without the flared skirt utilized in the positive shutoff detail of FIG. 3.
Figure 8:
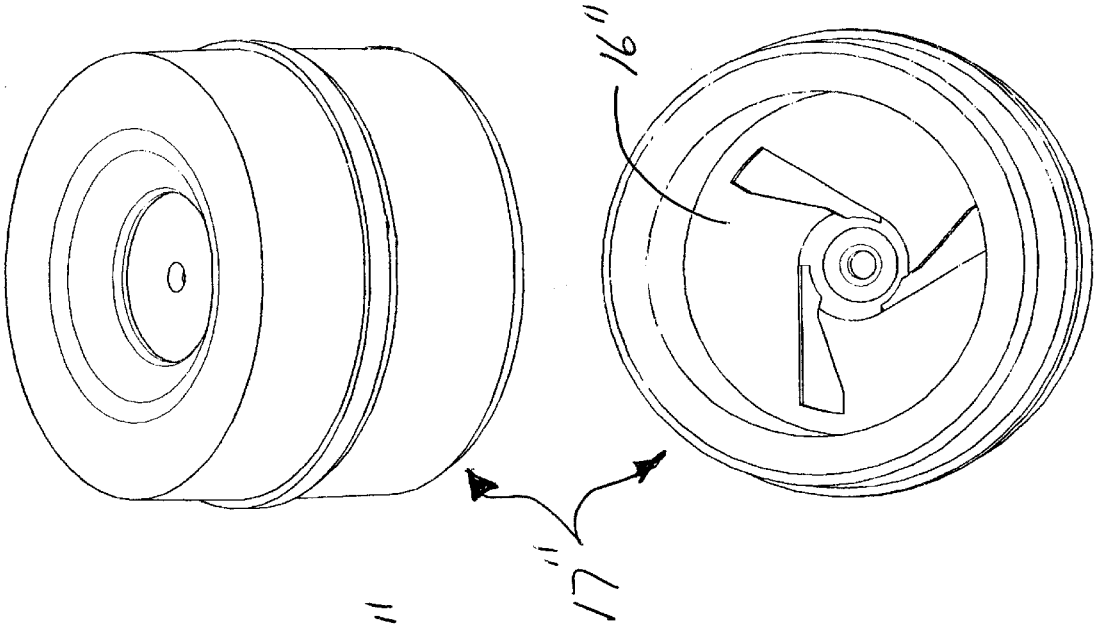
FIG. 8 is a detailed sectional view of yet another Cans of the overmold concept that shows supportive isometric views as in FIG. 8, demonstrating a further simplified version.
Figure 8:
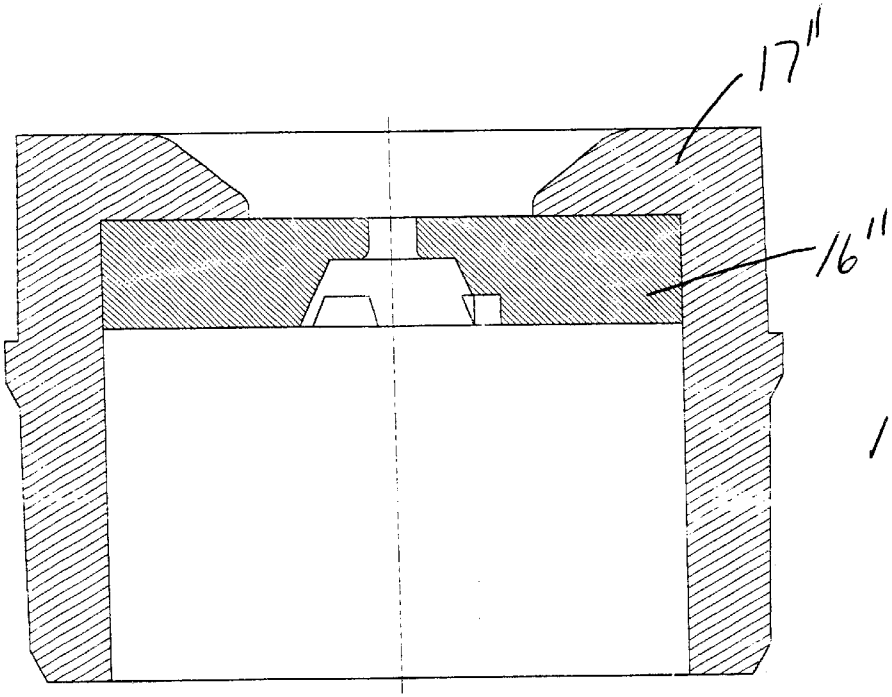

FIGS. 7 and 8 are area reductions affecting the Flexible Face Inner Fitment whereas in FIG. 7, the Flared Skirt Lower Diaphragm 16*e* is eliminated leaving all the other interfacing elements in place, with 16 prime to serve as described and shown in FIG. 3.

In FIG. 8, the same applies in FIG. 7 with the exception of the Flexible side wall, (see FIG. 5A 19*w*) being eliminated as well as the flared skirt 16*e* in FIG. 7 as shown and the remaining portion of 16*e* becomes 16 double prime. The function of FIG. 8 is prepared to serve as only the Non Clogging feature within the unitary overmold assembly bond.

In the above-disclosed embodiments, the materials of the overmolded fitment and actuator are not limiting factors in the disclosed invention and those materials durometers-densities specifically shown are presented only for the purposes of illustration.

Since numerous modifications and combinations of the above apparatus and method or processes in manufacturing arise out of technologies new and old, and these embodiments will readily occur to those skilled in the art, it is not desired to limit the invention to the exact construction and processes shown and described above. Accordingly, resort may be made to all suitable modifications and equivalents that fall within the scope of the invention as defined by the claims which follow. The words "comprise", "comprises", "comprising", "include(s)", and "including" when used in this specification and in the following claims are intended to specify the presence of stated features or steps, but they do not preclude the presence or addition of one or more other features, steps, or groups thereof.

What is claimed is:

1. An actuator with overmold assembly, comprising:

(a) a post carried within the actuator assembly, the post having a side wall and post face;

(b) and at a predetermined distance below, a frustrum shoulder, all on the same axis;

(c) a flexible diaphragm fitment inner half, disposed over the post, the flexible diaphragm fitment inner half, having a flexible diaphragm fitment inner side wall and flexible diaphragm fitment inner half face;

(d) wherein the flexible diaphragm fitment inner half, has a first position in which the flexible diaphragm fitment inner half, side wall sealibly contacts the actuator post side wall and the flexible diaphragm fitment inner half, face sealibly contacts at least a portion of the actuator post face; having a outlet orifice, which seals in a biased relationship against a portion of the said post, at a central location on its face;

(e) wherein the flexible diaphragm fitment inner half, has a second position in which the flexible diaphragm fitment inner half, side wall flexes away from the actuator post side wall, and flexible diaphragm fitment inner half, face flexes away from at least a portion of the actuator post face, at the said central location on its face;

(f) wherein the assembly and in combination with the flexible diaphragm fitment inner half, there is a compression fitment outer half, which is overmolded as a laminated and bonded part that makes the combination into a unitary piece that is molded in two different materials, the flexible diaphragm fitment inner half and the compression fitment outer half which becomes a laminate bond and the second stage of the unitary piece which is disposed about the flexible diaphragm fitment inner half, side wall, the compression outer fitment arrests the flex of the flexible diaphragm fitment inner half, side wall at a predetermined distance away from the actuator post side wall and retains the unitary piece in the actuator assembly in proper functional relationship.

2. The assembly of claim 1, further comprising a raised hemispheric nipple at a central location on the actuator post face disposed to a biased sealed fit with a outlet orifice in a central location on the flexible diaphragm fitment inner half face.

3. The assembly of claim 1, further comprising a flared flexible portion of the diaphragm flexible fitment inner half, which sealibly contacts a portion of a frustrum shoulder on the actuator post,and a compression fitment outer half becomes a laminate bond and other half of the unitary piece which is disposed about the flexible diaphragm fitment inner half forming, the lower in tandum diaphragm, that opens at a predetermined pressure, provided by a system reservoir holding a liquid under pressure in fluid communication with the actuator post side wall which in combination with the said flared flexible portion, forms a valve that releases said fluid at the first position when a threshold pressure is overcome at which time, the said fluid engages the flexible fitment inner half diaphragm forming the upper in tandem part and second position which interfaces with the outlet orifice on the face of the diaphragm flexible fitment inner half, acting as the second valve in tandem with the first of the two in tandem diaphragms.

4. The assembly of claim 2, wherein the diaphragm flexible fitment inner half portion is urged from a second position to a first position when pressure reaches a predetermined level occurring at each said position, comprising of the upper and lower in tandem diaphragms, along the actuator post axial side wall, and across the hemispheric nipple on the face of the actuator post, central to the axis of the actuator post ice as well as along a wall with a actuator receiving pocket down a distance from the actuator post face in sealing contact with the flared skirt portion of the lower diaphragm of the flexible diaphragm inner fitment half, wherein a biased sealed fit "at rest" state existed between the frustrum shoulder on the actuator post and said flared skirt, before incoming predetermined pressure is developed within.

5. The assembly of claim 1, further comprising a mechanical-turbo-vortexing breakup consisting of a number of tangential channels on the actuator post face, located within the area between the half hemispheric nipple on the actuator post face and the periphery of the actuator side wall of the same post within the actuator assembly.

6. The assembly of claim 1, wherein the actuator post face is smooth around the area outside of the half hemispheric nipple on the face of the actuator.

7. The assembly of claim 1, wherein the mechanical-turbo-vortexing breakup set of tangentials are on the interfacing surface of the flexible diaphragm fitment inner half, surrounding the half hemispherical nipple in a biased and sealed fit, on all areas except the tangential channels which feed the liquid under pressure to overcome the upper diaphragm bias and upper tandem valve comprising of the seal between the flexible fitment inner half orifice and the half hemispheric nipple on the actuator post face.

8. The assembly of claim 3, wherein the lower flared portion tandem valve and the frustrum on the base of the post is omitted and only the upper diaphragm of the dual tandem valve is used.

9. The assembly of claim 1, wherein the compression fitment outer half is of a rigid material.

10. A method of creating the assembly of claim 1, of molding two or more materials of different durometers to produce the actuator assembly portion that make up the flexible diaphragm inner half and the compression fitment outer half as a bonding laminate to form a unitary mechanical breakup combination for different interfacing vortexing channels with either the actuator post face or the interfacing surface of the flexible diaphragm fitment inner half portion.

11. The method of making the actuator of claim 1, to accommodate a retrofitted portion of the actuator post and unitary dual tandem diaphragms-valves fitment and compression fitment outer half to be assembled on conventional equipment utilized in industry for existing two piece actuator systems.

12. An apparatus wherein two different materials of two different durometers are together bonded in combination through a overmold process method, providing a dual functioning diaphragm-valving system for dispensing liquid under pressure through two diaphragms that are in tandem including a mechanical breakup (MBU) means between two in tandem diaphragms and a interfacing actuator post with a hemispheric nipple, centered on the actuator post face, sealing an outlet orifice in the diaphragm fitment inner half, face, dispensing a liquid as an atomized or agitated product through a outlet orifice within the upper half of a flexible diaphragm fitment inner half portion of a unitary overmold and a compression fitment outer half of same unitary overmold, forming a one piece unitary insert combination that retains the unitary insert into a actuator.

* * * * *